United States Patent [19]

Avella

[11] Patent Number: 4,623,195

[45] Date of Patent: Nov. 18, 1986

[54] POSITION RETAINING DEVICE FOR DRAFTSMAN CHAIR

[75] Inventor: Frank S. Avella, Irvine, Calif.

[73] Assignee: Plan Hold Corporation, Irvine, Calif.

[21] Appl. No.: 749,319

[22] Filed: Jun. 26, 1985

[51] Int. Cl.[4] ..... A47C 7/50

[52] U.S. Cl. ..... 297/437; 248/230

[58] Field of Search ..... 297/437, 423; 248/230

[56] References Cited

U.S. PATENT DOCUMENTS

| | | | |
|---|---|---|---|
| 1,723,363 | 8/1929 | McArdle | 297/437 |
| 1,854,478 | 4/1932 | Meyers | 248/230 |
| 2,529,173 | 11/1950 | Moyer et al. | 248/230 |
| 3,458,234 | 7/1969 | Bates | 297/437 |
| 3,564,743 | 2/1971 | Gilmoure | 248/230 |
| 4,167,033 | 9/1979 | Fletcher | 248/230 |

*Primary Examiner*—Francis K. Zugel

*Attorney, Agent, or Firm*—Poms, Smith, Lande & Rose

[57] ABSTRACT

A draftsman's chair having a footrest adjustable vertically along a support column for the chair; the footrest having a sleeve hub slidable on the column wherein a retaining device comprising a pair of interconnected spaced rings receives the sleeve hub there between and an interconnecting member provides a threaded hole for an adjustable knob having a shaft with an end face adapted to bear against the sleeve hub and to cause lateral displacement of the spaced rings to provide oppositely directed pressure contact against the support column to firmly position and retain the footrest at a selected position.

2 Claims, 4 Drawing Figures

POSITION RETAINING DEVICE FOR DRAFTSMAN CHAIR

BACKGROUND OF INVENTION

Chairs for a draftsman usually provide an elevated seat so that as the draftsman works at a drafting table from the elevated seat his legs are unable to reach to the floor. A footrest is provided for the draftsman's comfort and is adjustable vertically along the support column of the chair to a location most comfortable for the legs of the draftsman.

Prior proposed devices for retaining such a footrest at a selected height included set screws or devices which contacted and applied a holding force directly to the support column or to an intermediate sleevelike bushing encircling the column. The support column was often a pneumatic cylinder which facilitated changing the elevation of the chair. Applying a set screw or clamping force to a pressure area of very small area concentrated the pressure and sometimes caused distortion of the column which resulted in malfunctioning of the pneumatic cylinder. When the set screw or clamping force was applied to an intermediate bushing, a sufficient tightening force was difficut to achieve and slipping of the footrest downwardly would often occur when the draftsman's weight was placed on the footrest. Thus, positive retention and positioning of the footrest at a desired height was difficult to consistently achieve and such prior devices often resulted in damage to the support column of the chair.

SUMMARY OF INVENTION

The present invention contemplates a position and retaining device for a footrest for a draftsman's chair which may be readily operated and which may apply a holding pressure to the support column in a manner which reduces to a minimum the damage to the column and firmly secures the footrest from slipping when the draftsman's weight is placed thereon.

The primary object of the present invention, therefore, is to provide a position and retaining device in which spaced pressure areas are provided for retaining a sleeve hub in a selected position along a column.

An object of the invention is to provide a position and retaining device for a footrest or like article for a draftman's chair in which the retaining device may be inexpensively manufactured and readily installed.

Another object of the invention is to provide a position and retaining device for a footrest on a chair wherein a pair of spaced rings are located on a column with a footrest sleeve hub therebetween, the rings being interconnected by an external longitudinally extending member which carries an adjustment knob and shaft for applying pressure to the sleeve hub in one direction while causing the spaced rings to move in the opposite direction to provide enlarged spaced pressure areas on the column for reducing to a minimum potential damage to the column.

A further object of the invention is to provide a position retaining device readily made from a flat metal sheet stock by a stamping and bending process, and which, alternatively, also may be readily made by a casting method with an integral structure.

A still further object of the invention is to provide a position retention device which may be readily assembled with the support column of the chair and readily operable to select a desired height for a footrest slidable along the column of the chair.

Various objects and advantages of the present invention will be readily apparent from a following description of the drawings in which an exemplary devlce of this invention is shown.

DETAILED DESCRIPTION OF THE INVENTION

Figure 1:
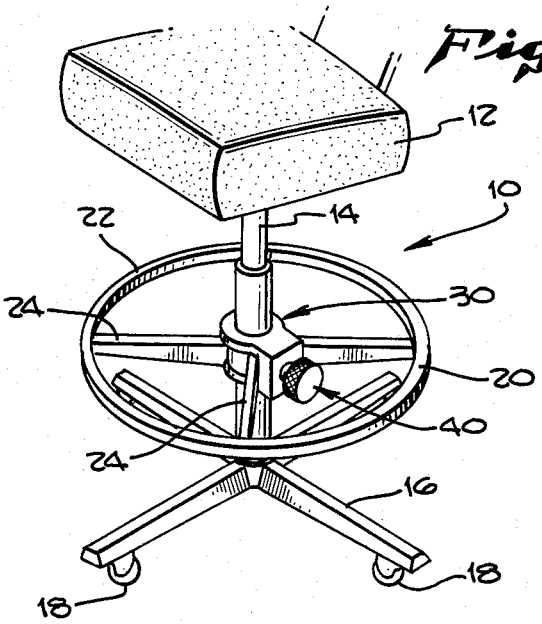
FIG. 1 is a perspective view of a draftsman's chair having a footrest provided with a position retaining device of this invention.
Figure 4:
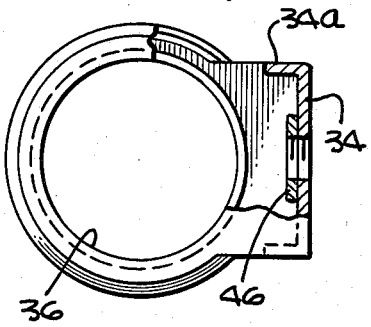
FIG. 4 is a top plan view of the retaining device of this invention, partly in section.

In FIG. 1 an exemplary draftsman's chair generally indicated at 10 embodying this invention includes a seat 12 supported by a single stepped pneumatic support column 14 which rises upwardly from a base means 16 having suitable casters 18 at outer ends of base arms to facilitate movement of the draftsman's chair. Intermediate ends of column 14 is provided a footrest 20 comprising a circular or ring member 22 of suitable diameter to facilitate resting of a foot or feet of a draftsman thereon when the draftsman is seated on seat 12. Ring member 22 also includes diametrically arranged spokes 24 extending outwardly from a sleeve hub member 26 through which passes column 14. Hub 26 has a sliding fit on column 14, FIG. 2 exaggerating the clearances of the sliding fit for the purposes of explaining this invention.

Figure 2:
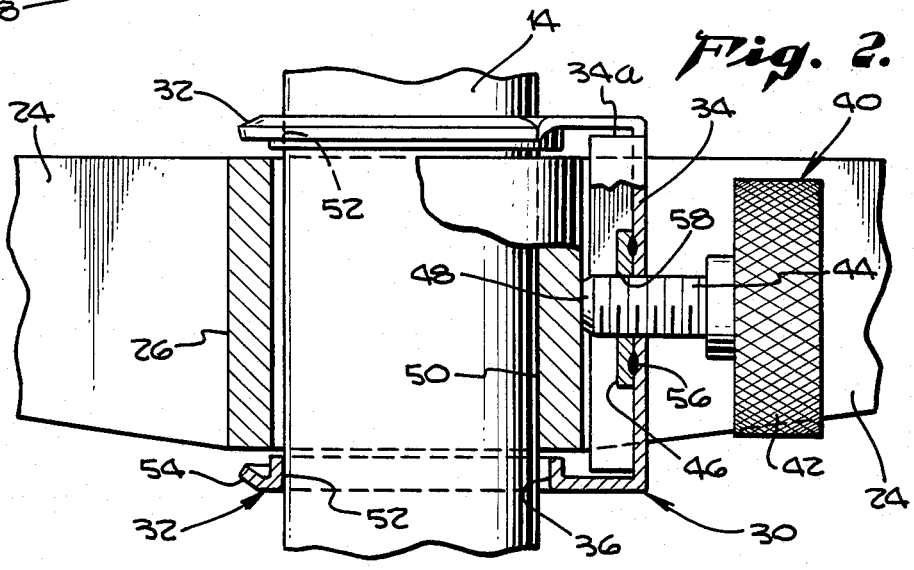
FIG. 2 is a fragmentary sectional view taken in a vertical plane passing through the axis of the chair support column and the adjustment knob.

This position retaining device of this invention is generally indicated at 30. Device 30 includes spaced rings 32 slidable on column 14 and spaced apart a distance so that the sleeve hub 26 lies between the spaced rings 32. Rings 32 are interconnected at one side and at circumferential opposed portions thereof by a longitudinally extending plate or bar-like member 34. Member 34 is disposed externally of hub 26 and is spaced therefrom as shown in FIG. 2. Openings 36 of the rings 32 have a sliding fit on column 14 and for purposes of this explanation, the clearance of this fit is exaggerated as shown in FIG. 2 to show a space between the ring opening 36 and one side of the outer cylindrical surface of column 14.

An adjustable tightening knob means 40 is provided with a knob head 42 of suitable diameter to facilitate applying sufficient leverage force to the threaded shaft 44 of the adjustable knob. Shaft 44 has threaded engagement with longitudinal member 34 at a central portion thereof and such threaded engagement is enlarged and strengthened by a threaded reinforcement plate 44 carried on the internal surface of member 34.

In assembly and in operation the retaining device 30 may be positioned between the spokes 24 of footrest 20 and with one ring 32 above or at the end of the sleeve hub 26 and the other ring positioned at below or at the other end of the sleeve hub 26. This assembly may then be moved axially over the column 14 before the seat or before the base means 16 is assembled with the column.

In operation of the retaining device 30 the footrest is adjusted along the column to a selected height that is convenient for the leg length of the draftsman using the chair. When the selected position has been chosen, the knob 40 may be turned to cause the end face 48 of threaded shaft 44 to press against a central portion of the exterior cylindrical surface of the sleeve hub 26. As a pressure is applied to the sleeve hub, the sleeve hub will be caused to move transversely or laterally of the longitudinal axis of column 14 and to press contacting areas at 50 of the internal surface of the sleeve hub against the opposed external cylindrical surfaces fo column 14. As this pressure over a vertical arcuate area between the sleeve hub 26 and the cylindrical column 14 occurs, the rings 32 are moved laterally or transversely in a direction opposite to such pressure being applied at 50 to cause spaced pressure contact at 52, 52 of the top and bottom rings 32 against cylindrical surface areas of the column diametrically opposite to the contacting surfaces at 50 of the hub sleeve with the column. Thus, on the adjustment knob side of column 14 pressure is applied to the surface of the column over an extended surface area as compared to the area of a circular end face of shaft 44. On the diametrically opposite side of the column, pressure is applied at longitudinally spaced areas and each pressure area corresponds with the height of a ring 32 in contact with the column surface. Such distribution of pressure forces on opposite sides of the cylindrical column 14 reduces substantially and minimizes the danger of deforming the metal of column 14 in order to fixedly locate and retain the footrest in a selected position. Operability of the pneumatic column 14 is maintained and damage thereto is virtually eliminated as caused by adjusting the height of the footrest and retaining the footrest at the selected height or position.

Figure 3:
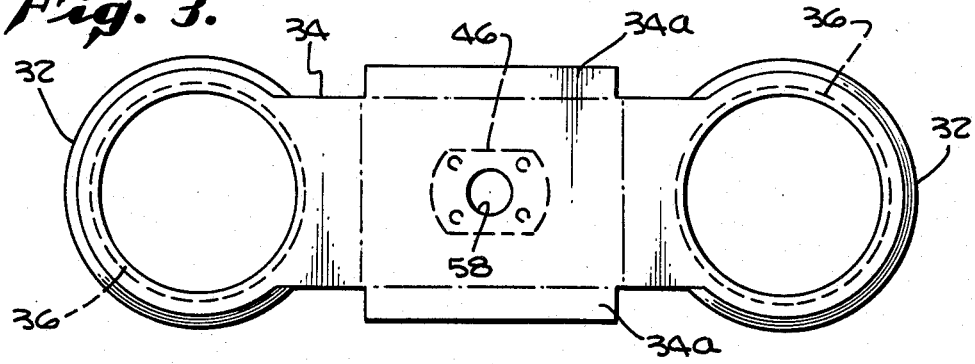
FIG. 3 is a plan view of a blank of sheet material partially stamped in the process of forming the retaining device of this invention.

The retaining device of this invention may be conveniently made from flat sheet metal stock by a stamping process. As shown in FIG. 3 a suitable blank of flat sheet metal stock 60 may be stamped to the configuration shown which comprises a ring 32 at each end of an interconnecting member 34 having stiffening edge flanges 34*a*. Each ring is provided with an inturned flange 36 having suitable bearing area for contact with the cylindrical surface of column 14 provided by a selected depth of flange 36. Each ring 32 has a radially outwardly extending flange 54 which may be suitably angularly inclined with respect to the axis of the ring for stiffening purposes. After the blank is stamped and provided with the desired configuration of rings 32, the rings 32 may be axially aligned by bending at transverse lines spaced apart a sufficient distance so that when the rings 32 are axially aligned and in parallel relationship, the height of hub sleeve 26 may be contained therebetween. After such forming of the blank of sheet metal, reinforcement plate 46 may be suitably spotwelded as at 56 to the portion 34 and a hole 58 punched therein may be suitably threaded.

While the method of stamping the configuration of the retaining clamping device 30 from a blank of flat metal is preferred because of the economy of such a production operation, it will be understood that a device 30 may be made by a die cast method in which the rings 32 may comprise an annulus of solid metal material integrally interconnected by a member 34. Other methods of forming or fabricating the retaining device of the invention are also possible.

It will be further understood that various changes and modifications may be made in the device of the invention described above and which come within the spirit of this invention and also changes and modifications coming within the scope of the amended claims are embraced thereby.

I claim:

1. In combination with a chair having a seat supported by a column and an adjustable footrest having a sleeve-like hub movable and positionable along said column, the provision of:

means for retaining the footrest in a selected position on the column including a pair of spaced rings slidably engageable with said column at opposite ends of said hub;

a longitudinally extending member interconnecting said rings at circumferential portions thereof and external to said hub;

and an adjustable knob having a threaded shaft in threaded engagement with said longitudinal member, the end face of said shaft being in contact with said hub whereby tightening of said adjustable knob urges said spaced rings laterally in one direction into spaced pressure contact with said column, and said internal surface of said hub adjacent the contact of said shaft end with said hub is urged laterally in an opposite direction into pressure contact with the opposite side of said column between said spaced rings.

2. The combination as claimed in claim 1 wherein said retaining means comprises integral rings and longitudinal member.

* * * * *